US011520251B2

(12) United States Patent
Takemoto

(10) Patent No.: US 11,520,251 B2
(45) Date of Patent: Dec. 6, 2022

(54) DEVELOPER CONVEYOR HAVING HELICAL BLADES AND PROTRUSIONS

(71) Applicant: Hewlett-Packard Development Company, L.P., Spring, TX (US)

(72) Inventor: Kazuhiko Takemoto, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/416,660

(22) PCT Filed: Jun. 23, 2020

(86) PCT No.: PCT/US2020/039108
§ 371 (c)(1),
(2) Date: Jun. 21, 2021

(87) PCT Pub. No.: WO2020/263809
PCT Pub. Date: Dec. 30, 2020

(65) Prior Publication Data

US 2022/0107588 A1 Apr. 7, 2022

(30) Foreign Application Priority Data

Jun. 28, 2019 (JP) ..... JP2019-121031

(51) Int. Cl.
*G03G 15/08* (2006.01)
*G03G 15/09* (2006.01)

(52) U.S. Cl.
CPC ..... *G03G 15/0891* (2013.01); *G03G 15/0893* (2013.01); *G03G 15/09* (2013.01);
(Continued)

(58) Field of Classification Search
CPC ..... G03G 15/0891; G03G 15/09; G03G 15/0921; G03G 15/0887; G03G 15/0889;
(Continued)

(56) References Cited

U.S. PATENT DOCUMENTS 9,304,446 B2 4/2016 Akita et al.
2008/0069580 A1* 3/2008 Oshige ..... G03G 15/0893 399/62

(Continued)

FOREIGN PATENT DOCUMENTS

CN 107024844 A 8/2017
JP 2000019823 A 1/2000

(Continued)

*Primary Examiner* — Walter L Lindsay Jr.
*Assistant Examiner* — Laura Roth
(74) *Attorney, Agent, or Firm* — Staas & Halsey LLP

(57) ABSTRACT

A developing device includes a developer carrier to carry a developer, and a developer conveyor to supply the developer to the developer carrier. The developer conveyor includes a shaft extending in an axial direction to rotate in a rotational direction, a helical blade having a conveying surface to convey the developer around the shaft along the axial direction, and a protrusion attached to a rear surface of the helical blade, which faces the conveying surface, and having a leading surface extending from an upstream end to a downstream end in the rotational direction of the shaft.

20 Claims, 9 Drawing Sheets

(52) U.S. Cl.
CPC . *G03G 15/0921* (2013.01); *G03G 2215/0827* (2013.01); *G03G 2215/0838* (2013.01)

(58) Field of Classification Search
CPC ..... G03G 15/0893; G03G 2215/0609; G03G 2215/0838; G03G 2215/0827; G03G 2215/841; G03G 2215/0844; G03G 2215/0847
See application file for complete search history.

(56) References Cited

U.S. PATENT DOCUMENTS

| | | | | |
|---|---|---|---|---|
| 2011/0311279 | A1* | 12/2011 | Okazaki | G03G 15/0893 399/254 |
| 2012/0269555 | A1* | 10/2012 | Matsumoto | G03G 15/0893 399/258 |
| 2013/0022373 | A1* | 1/2013 | Bucks | G03G 15/0893 399/256 |
| 2015/0338824 | A1* | 11/2015 | Shimizu | G03G 15/095 399/270 |
| 2017/0343926 | A1 | 11/2017 | Yago | |
| 2018/0120752 | A1* | 5/2018 | Shima | G03G 15/757 |
| 2019/0227460 | A1* | 7/2019 | Mishima | G03G 15/0891 |

FOREIGN PATENT DOCUMENTS

| | | |
|---|---|---|
| JP | 2006126484 | 10/2004 |
| JP | 2010217697 | 3/2009 |
| JP | 2016099378 | 11/2014 |
| JP | 2016133706 | 1/2015 |

* cited by examiner

DEVELOPER CONVEYOR HAVING HELICAL BLADES AND PROTRUSIONS

BACKGROUND

A developing device of an image forming system includes a developer carrier that carries a developer to form images from toner contained in the developer, and a developer conveyor that supplies the developer to the developer carrier.

DETAILED DESCRIPTION

Hereinbelow, an example image forming system will be described with reference to the drawings. The image forming system may be an image forming apparatus such as printer, or may be a part (for example, a developing system or device, and/or the like) of the image forming apparatus.

In the following description, with reference to the drawings, the same reference numbers are assigned to the same components or to similar components having the same function, and overlapping description is omitted.

Example Image Forming Apparatus

Figure 1:
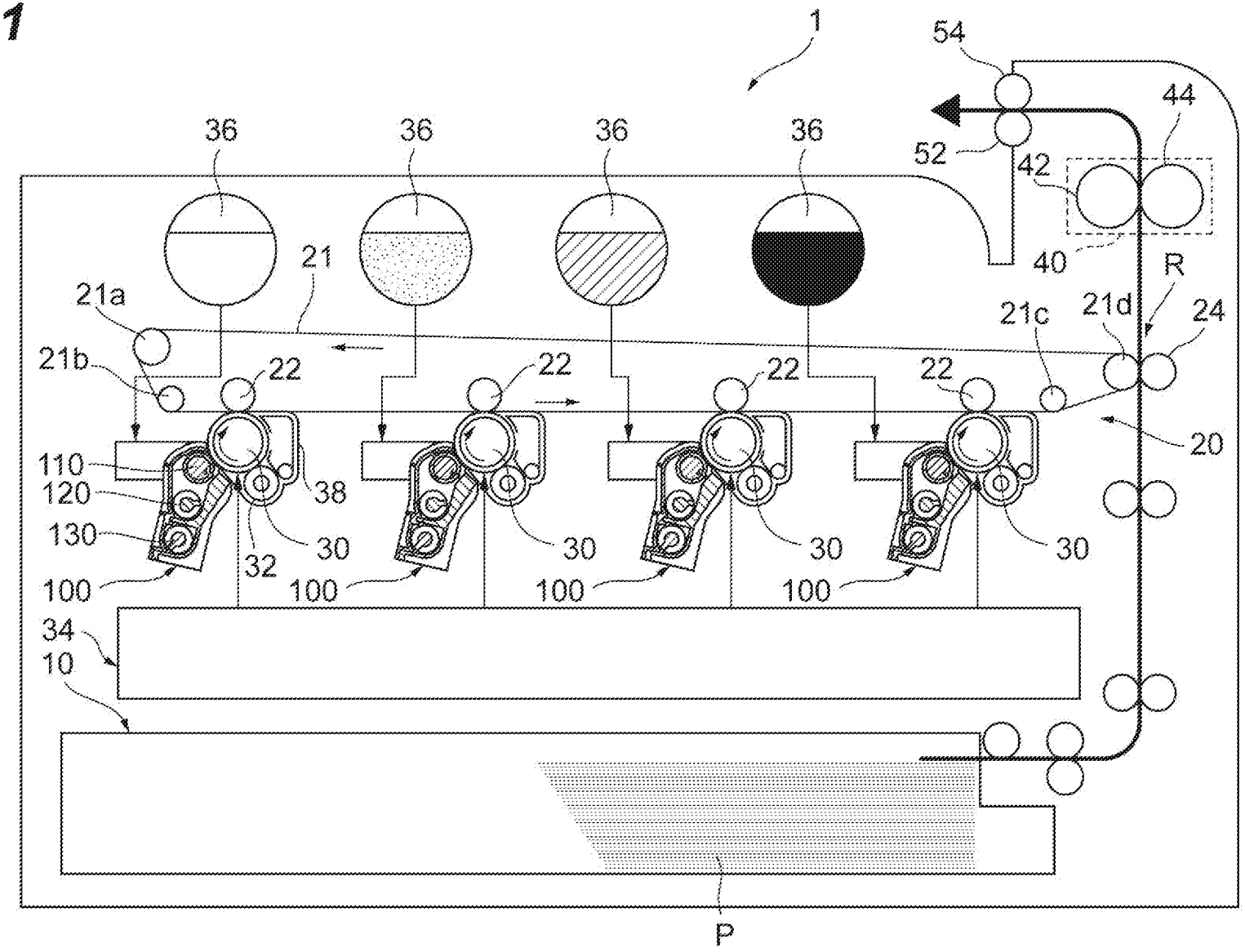
FIG. 1 is a schematic diagram illustrating an example image forming apparatus.

With reference to FIG. 1, an example image forming apparatus 1 may include a recording medium conveying unit (or recording medium conveying device) 10, a transfer unit (or transfer device) 20, a photoconductor drum 30, four developing devices 100, and a fixing unit (or fixing device) 40.

The recording medium conveying unit (or device) 10 contains a paper (or paper sheet) P as a recording medium on which a final image is to be formed. The recording medium conveying unit (or device) 10 transports the paper P to a recording medium conveying path. The paper sheets P may be stacked, one on top of another, inside a cassette. The recording medium conveying unit (or device) 10 causes the paper P to reach a secondary transfer region R at a time a toner image being transported by the transfer unit (or device) 20 reaches the secondary transfer region R.

The transfer unit (or device) 20 conveys the toner image, which has been formed by the photoconductor drum 30, to the secondary transfer region R. The transfer unit (or device) 20 may include, for example, a transfer belt 21, suspension rollers 21*a*, 21*b*, 21*c*, and 21*d* on which the transfer belt 21 is suspended, a primary transfer roller 22 that pinches the transfer belt 21 between the primary transfer roller 22 and the photoconductor drum 30, and a secondary transfer roller 24 that pinches the transfer belt 21 between the secondary transfer roller 24 and the suspension roller 21*d*. The transfer belt 21 may include an endless belt that is circularly moved by the suspension rollers 21*a*, 21*b*, 21*c*, and 21*d*. The primary transfer roller 22 presses against the photoconductor drum 30 from an inner circumferential side of the transfer belt 21. The secondary transfer roller 24 presses against the suspension roller 21*d* from an outer circumferential side of the transfer belt 21. In addition, the transfer unit (or device) 20 may include a belt cleaning device, and the like, that remove toner (e.g., toner particles) attached to the transfer belt 21.

The photoconductor drum 30 is an electrostatic latent image carrier which enables an image to be formed on a circumferential surface thereof. The photoconductor drum 30 may be, for example, an organic photoconductor (OPC). The example image forming apparatus 1 of FIG. 1 is an apparatus capable of forming a color image. The example image forming apparatus 1 includes four photoconductor drums 30 corresponding to four colors, respectively, for example yellow, magenta, cyan, and black. The photoconductor drums 30 are spaced apart along a movement direction of the transfer belt 21. As illustrated in FIG. 1, for example, a charging roller 32, an exposure unit (or exposure device) 34, a developing device 100, and a cleaning unit (or cleaning device) 38 may be provided around or adjacent each of the photoconductor drums 30.

The charging roller 32 uniformly charges the surface of the photoconductor drum 30 with a predetermined potential. The exposure unit (or device) 34 exposes the surface of the photoconductor drum 30, which has been charged by the charging roller 32, to light according to an image to be formed on the paper P. Therefore, the potential of a portion of the surface of the photoconductor drum 30, which has been exposed to light by the exposure unit (or device) 34, is changed, and an electrostatic latent image is formed. Toner is supplied to the four developing devices 100 from respective toner tanks 36 which are provided for each of the developing devices 100. Each developing device 100 generates a toner image by developing the electrostatic latent image, which has been formed on the photoconductor drum 30, with the toner. The associated toner tank 36 may contain a developer for supply, which is a mixture of color toner and carrier particles. For example, the four toner tanks 36 respectively contain a first developer for supply obtained by mixing together a yellow toner and a carrier, a second developer for supply obtained by mixing together a magenta toner and a carrier, a third developer for supply obtained by mixing together a cyan toner and a carrier, and a fourth developer for supply obtained by mixing together a black toner and a carrier.

The cleaning unit (or device) 38 recuperates (e.g., collects) a toner (e.g., toner particles) remaining on the photoconductor drum 30 after the toner image on the photoconductor drum 30 has been primarily transferred onto the transfer belt 21. The cleaning unit (or device) 38 may be, for example, configured to remove the remaining toner on the photoconductor drum 30 by bringing a cleaning blade into contact with the circumferential surface of the photoconductor drum 30. In addition, a charge eliminating lamp that resets the electrical potential of the photoconductor drum 30 may be disposed around or adjacent the photoconductor drum 30 between the cleaning unit (or device) 38 and the charging roller 32 in a rotation direction of the photoconductor drum 30.

The fixing unit (or device) 40 fixes the toner image, which has been secondarily transferred onto the paper P from the transfer belt 21, onto the paper P. The fixing unit (or device) 40 includes, for example, a heating roller 42 and a pressing roller 44. The heating roller 42 is, for example, a cylindrical member capable of rotating around a rotation axis. A heat source such as a halogen lamp is provided inside the heating roller 42. The pressing roller 44 is, for example, a cylindrical member that is rotatable around a rotation axis. The pressing roller 44 presses against the heating roller 42. Each of the heating roller 42 and the pressing roller 44 may include a heat-resistant elastic layer formed of, for example, silicone rubber, and the like, provided on an outer circumferential surface. When the paper P passes through a fixing nip portion which is a region of contact between the heating roller 42 and the pressing roller 44, the toner image is fused and fixed onto the paper P.

In addition, the image forming apparatus 1 may be provided with output rollers 52 and 54 for outputting the paper P, onto which the toner image has been fixed by the fixing unit (or device) 40, to the outside from the apparatus.

Example Operation of the Image Forming Apparatus

An example operation of the example image forming apparatus 1 will be described. When an image signal for a recorded image is input to the image forming apparatus 1, a control unit (or controller) of the image forming apparatus 1 causes the charging roller 32 to uniformly charge the surface of the photoconductor drum 30 with a predetermined potential. Then, the control unit (or controller) of the image forming apparatus 1 causes the exposure unit (or device) 34 to irradiate the surface of the photoconductor drum 30 with laser beams based on the received image signal, to form an electrostatic latent image.

The developing device 100 adjusts the mixing ratio of the toner and the carrier to a targeted or selected mixing ratio, and mixes together and agitates (e.g., stirs) the toner and the carrier. The developing device 100 uniformly disperses the toner, and adjusts the developer so that an optimal or targeted charge can be provided to the developer. The adjusted developer is carried (held) by a developing roller 110. Then, when the developer is conveyed to a region (supply location) facing the photoconductor drum 30 by the rotation of the developing roller 110, the toner in the developer carried by the developing roller 110 moves onto the electrostatic latent image formed on the circumferential surface of the photoconductor drum 30, and the electrostatic latent image is developed. The toner image formed in this manner is primarily transferred from the photoconductor drum 30 onto the transfer belt 21 in a region where the photoconductor drum 30 and the transfer belt 21 face each other. The toner images formed on the four photoconductor drums 30 are sequentially layered (or superimposed) onto the transfer belt 21, and as a result, a single composite toner image is formed. Then, the composite toner image is secondarily transferred onto the paper P, which has been transported from the recording medium conveying unit (or device) 10, in the secondary transfer region R where the suspension roller 21*d* and the secondary transfer roller 24 face each other.

The paper P, onto which the composite toner image has been secondarily transferred, is transported to the fixing unit (or device) 40. When the paper P passes between the heating roller 42 and the pressing roller 44 while being subjected to heat and pressure, the composite toner image is fused and fixed onto the paper P. Thereafter, the paper P is output to the outside from the image forming apparatus 1 by the output rollers 52 and 54. In some examples, a belt cleaning device removes the residual toner remaining on the transfer belt 21, after the composite toner image has been secondarily transferred onto the paper P.

Example Developing Device

An example developing device 100 may use, for example, a two-component developer containing a toner and a carrier, as the developer. In order to extend the lifespan of the developer, the developing device 100 may output or release an aged developer (e.g., old developer) from a developer outlet, and supply a fresh developer (developer for supply) into a developer container.

Figure 2:
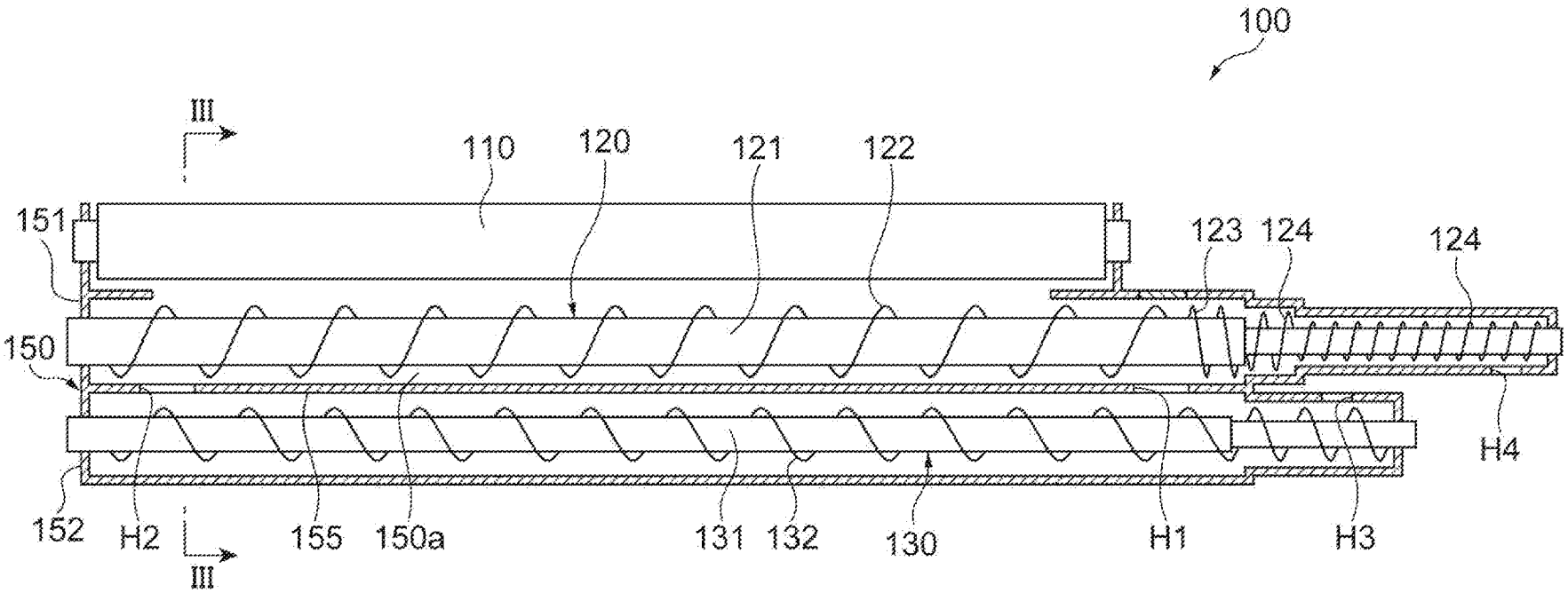
FIG. 2 is a schematic cross-sectional view of an example developing device of the image forming apparatus of FIG. 1.
Figure 3:
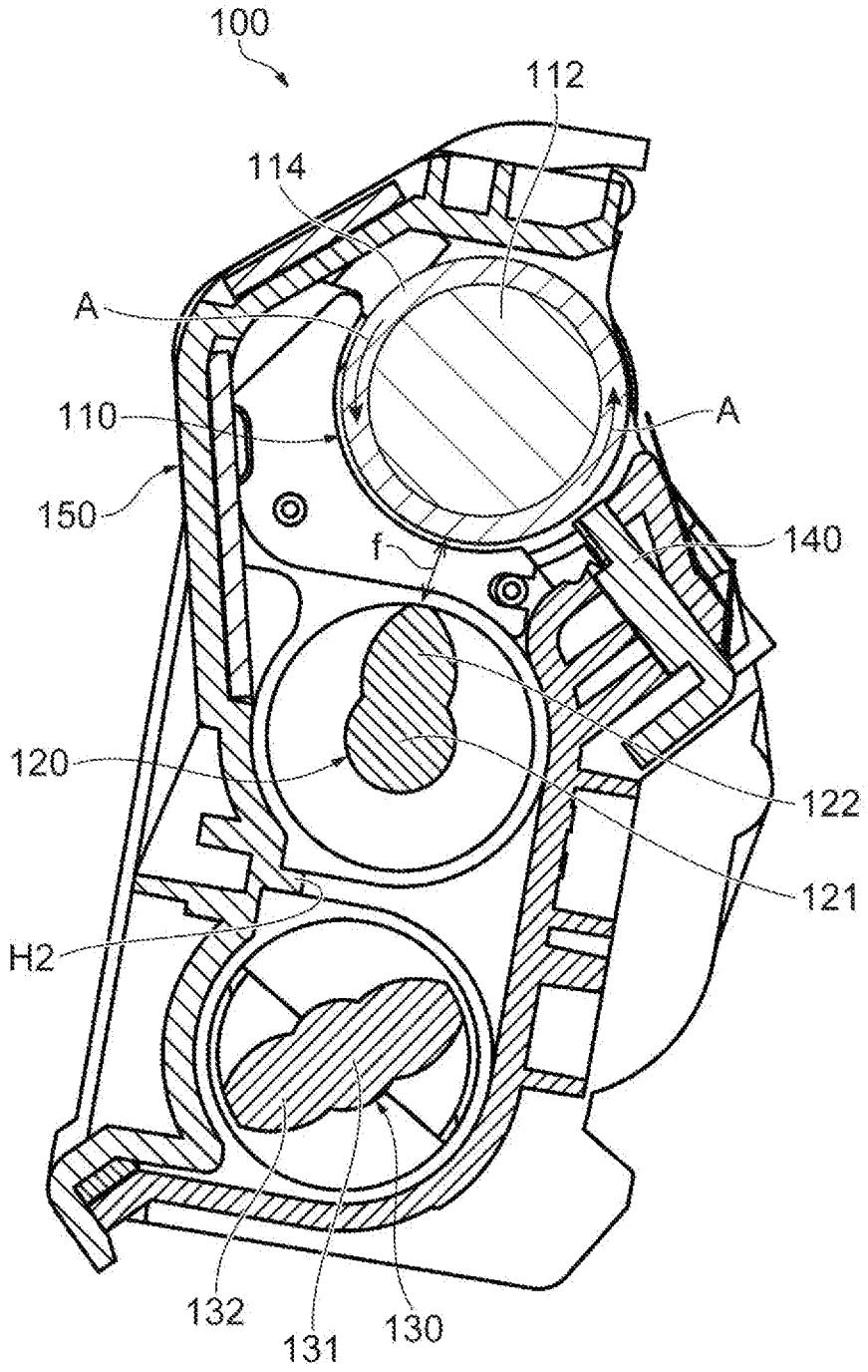
FIG. 3 is a cross-sectional view of the developing device taken along line of FIG. 2.

For example, with reference to FIGS. 2 and 3, the developing device 100 may include a developing roller 110, a first conveying member (developer conveyor) 120, a second conveying member 130, and a layer regulating member 140. The developing roller 110, the first conveying member 120, and the second conveying member 130 are housed inside a developer container 150*a* formed by a casing 150 of the developing device 100.

The developing roller 110 is a developer carrier that supplies the toner to the electrostatic latent image formed on the circumferential surface of the photoconductor drum 30. The developing roller 110 includes, for example, a developing sleeve 114, and a magnet 112 disposed inside the developing sleeve 114. The developing sleeve 114 is, for example, a tubular member made of non-magnetic metal. In the developing roller 110, the developing sleeve 114 rotates in a direction indicated by an arrow head A in FIG. 3, and the magnet 112 disposed inside the developing sleeve 114 is fixed to the casing 150. The developing roller 110 receives the developer from the first conveying member 120 by virtue of a magnetic force of the magnet 112, and conveys the developer to the photoconductor drum 30 by virtue of the rotation of the developing sleeve 114.

The layer regulating member 140 is provided at a location upstream of a datum location (e.g., a reference location), in the rotation direction of the developing sleeve 114, the datum location corresponding to a location where the developing sleeve 114 of the developing roller 110 and the photoconductor drum 30 (refer to FIG. 4) face each other. The layer regulating member 140 controls the thickness of a layer of the developer on the developing roller 110. For example, the layer regulating member 140 may level the developer attached to a circumferential surface of the developing sleeve 114, such that the developer forms a layer with a uniform thickness. The layer regulating member 140 may include, for example, a metallic blade.

The first conveying member 120 and the second conveying member 130 may charge the carrier and the toner using friction by agitating (e.g., stirring) the magnetic carrier and the non-magnetic toner of the developer inside the developer container 150*a*.

The casing 150 includes, for example, a first casing portion 151 and a second casing portion 152. The first casing portion 151 may house the developing roller 110 and the first conveying member 120. The second casing portion 152 may house the second conveying member 130.

The first conveying member 120 may supply the mixed and stirred developer to the developing roller 110. In some examples, the first conveying member 120 may be disposed downward of the developing roller 110 in the direction of gravity. The first conveying member 120 may include, for example, a first support shaft (shaft) 121 and a first helical blade (helical blade) 122. The first support shaft 121 may be rotatably supported by the first casing portion 151. The first helical blade 122 is provided on an outer circumferential surface of the first support shaft 121. The first helical blade 122 has helical conveying surfaces disposed along a longitudinal direction of the first support shaft 121.

The developing sleeve 114 which the first conveying member 120 supplies the developer to, may have a diameter (outer diameter) of 16 to 25 mm. In this case, a closest distance f between an outer circumferential surface of the developing sleeve 114 and an outer edge of the first helical blade 122 of the first conveying member 120 may be greater than or equal to 3.5 mm. For example, the closest distance f may satisfy the expression f≥3.5 mm.

The second conveying member 130 may charge the developer, for example, by mixing and stirring the developer, and convey the charged developer to the first conveying member 120. In some examples, the second conveying member 130 may be, for example, disposed downward of the first conveying member 120 in the direction of gravity. Similarly to the first conveying member 120, the second conveying member 130 may include, for example, a second support shaft 131 and a second helical blade 132. The second support shaft 131 may be rotatably supported by the second casing portion 152. The second helical blade 132 is provided on an outer circumferential surface of the second support shaft 131. The second helical blade 132 has helical conveying surfaces disposed along a longitudinal direction of the second support shaft 131.

The first conveying member 120 and the second conveying member 130 may be disposed side by side such that the first support shaft 121 and the second support shaft 131 are substantially parallel to each other. The first casing portion 151 is provided adjacent to the second casing portion 152 in a substantially vertical direction. In some examples, a lower portion of the first casing portion 151 and an upper portion of the second casing portion 152 are formed by one member (hereinbelow, referred to as a "partition plate 155"). Namely, the partition plate 155 serves as both a portion of the first casing portion 151 and a portion of the second casing portion 152. The partition plate 155 partitions the first conveying member 120 off from the second conveying member 130. A first opening H1 and a second opening H2 may be provided in the partition plate 155.

The developer may be delivered from inside of the first casing portion 151 into the second casing portion 152 through the first opening H1. The developer may be delivered from the second casing portion 152 to the first casing portion 151 through the second opening H2.

The developer conveyed while being stirred inside the second casing portion 152 by the second conveying member 130 may be fed into the first casing portion 151 through the second opening H2. The first helical blade 122 of the first conveying member 120 may convey the developer from the second opening H2 toward the first opening H1 while stirring the developer. While the developer is being conveyed by the first conveying member 120, part of the developer may move (e.g. may be transferred) onto a circumferential surface of the developing roller 110. The remaining developer which has not transferred onto the circumferential surface of the developing roller 110 is fed into the second casing portion 152 through the first opening H1.

A developer supply port H3 may be provided in the second casing portion 152 to supply a developer for supply (toner and carrier) is supplied into the second casing portion 152 through the developer supply port H3.

A developer output port H4 may be provided in the first casing portion 151. Old developer having aged due to a print operation is output or released to the outside from the developing device 100 through the developer output port H4 due to a change in the volume of the developer inside the developer container 150*a*. For example, a counter blade 123 and an output blade 124 may be provided in an end portion of the first conveying member 120, which is adjacent to the developer output port H4. The counter blade 123 is provided at a location between the first opening H1 and the developer output port H4. The counter blade 123 is provided on the outer circumferential surface of the first support shaft 121. The counter blade 123 has helical conveying surfaces disposed along the longitudinal direction of the first support shaft 121.

The counter blade 123 conveys the developer in a direction opposite to a conveying direction of the first helical blade 122, in order to push back the developer moving from the first opening H1 toward the developer output port H4.

The output blade 124 may be provided closer to the developer output port H4 than the counter blade 123. The output blade 124 is provided on the outer circumferential surface of the first support shaft 121. The output blade 124 has helical conveying surfaces disposed along the longitudinal direction of the first support shaft 121. The output blade 124 conveys the developer in the same direction as the conveying direction of the first helical blade 122. Namely, the output blade 124 conveys the developer from the first opening H1 toward the developer output port H4.

As described above, the counter blade 123 pushes the developer back to the first helical blade 122 such that the developer inside the developer container 150*a* does not move to the developer output port H4. When the amount of the developer inside the developer container 150*a* increases, the developer crosses over the counter blade 123. The developer which has crossed over the counter blade 123 is conveyed toward the developer output port H4 by the output blade 124.

Magnetic Forces of the Example Developing Roller

The example developing roller 110 will be described, with reference to FIG. 4. The magnet 112 of the developing roller 110 has at least a pulling pole (first magnetic pole) S3 and a layer regulating pole (second magnetic pole) N2. The pulling pole 33 forms a magnetic field (first magnetic field) that moves the developer from the first conveying member 120 to the developing roller 110. The layer regulating pole N2 is provided at a location facing the layer regulating member 140. The magnet 112 may be formed integrally with a shaft body of the developing roller 110, or may be formed separately from the shaft body.

In some examples, a peak pulling magnetic force (first peak magnetic force) b in a direction normal to the magnetic field formed by the pulling pole S3 may be less than a peak layer regulating magnetic force (second peak magnetic force) a in a direction normal to a magnetic field (second magnetic field) formed by the layer regulating pole N2. For example, the peak layer regulating magnetic force a and the peak pulling magnetic force b may satisfy the expression a>b. In addition, the total magnetic force of the peak layer regulating magnetic force a in the direction normal to the magnetic field formed by the layer regulating pole N2, and the peak pulling magnetic force b in the direction normal to the magnetic field formed by the pulling pole S3 may be less than or equal to 85 mT. For example, the peak layer regulating magnetic force a and the peak pulling magnetic force b may satisfy the expression a+b≤85 mT.

The peak pulling magnetic force b in the direction normal to the magnetic field formed by the pulling pole S3 may be, for example, less than or equal to 35 mT. The peak layer regulating magnetic force a in the direction normal to the magnetic field formed by the layer regulating pole N2 may be, for example, less than or equal to 50 mT. In some examples, a peak magnetic force (third peak magnetic force) c formed in a tangential direction between the layer regulating pole N2 (peak layer regulating magnetic force a) and the pulling pole S3 (peak pulling magnetic force b) may be, for example, less than or equal to 40 mT.

Example First Conveying Member

The example first conveying member 120 will be described, with reference to FIGS. 5 and 6. The first conveying member 120 may have, for example, a protrusion 125 provided on the outer circumferential surface of the first support shaft 121. For example, the first support shaft 121 may extend in the direction of an axis T, to rotate around the axis T in a rotation direction indicated by an arrow head N in FIG. 5. The first helical blade 122 may rise from the outer circumferential surface of the first support shaft 121, and extends helically around the first support shaft 121 along the direction of the axis T. One row of or a plurality of rows of the first helical blades 122 may be provided on the outer circumferential surface of the first support shaft 121. For example, the first conveying member 120 may include two rows of the first helical blades 122. In examples including a plurality of the first helical blades 122, the plurality of the first helical blades 122 may be offset along the direction of the axis T, such that for example, portions of the respective helical blades are alternately and repeatedly arranged on the outer circumferential surface of the first support shaft 121 along the direction of the axis T.

The first helical blade 122 has a conveying surface 122*a* that faces toward a downstream side of the first conveying member 120, with reference to a conveying direction M of the developer associated with the first conveying member 120. The first helical blade 122 has a back surface (or rear surface) 122*b* that faces toward an upstream side with reference to the conveying direction M of the developer associated with the first conveying member 120. If the first conveying member 120 rotates in the rotation direction indicated by the arrow head N, a developer G (cf. FIG. 5) around the first support shaft 121 is conveyed downward (downstream) in the conveying direction M along the direction of the axis T by the conveying surface 122*a*. In addition, while the developer G is being conveyed by the conveying surface 122*a*, part of the developer moves onto an outer circumferential surface of the developing roller 110. The developer conveyed by the conveying surface 122*a* of the first helical blade 122 is illustrated schematically in FIG. 5 as the developer G. The back surface 122*b* faces the conveying surface 122*a* in the direction of the axis T. The back surface 122*b* may be a non-conveying surface that does not convey the developer G.

The first conveying member 120 has a plurality of helical-blade portions. The helical-blade portion is a portion of the first helical blade 122. With reference to FIG. 5, a first helical-blade portion P1 is, for example, a portion of the first helical blade 122. A helical-blade portion P2 is a portion of the first helical blade 122, which is adjacent to the first helical-blade portion P1 in the direction of the axis T. For example, the first helical-blade portion P1 and the helical-blade portion P2 are spaced apart from each other along the direction of the axis T. A pitch w between the first helical-blade portion P1 and the adjacent helical-blade portion P2 in the direction of the axis T may be, for example, from 7 to 10 mm. For example, the pitch w may satisfy the expression 7 mm≤w≤10 mm. For example, the pitch w between portions of the first helical blades 122 that are adjacent to each other in the direction of the axis T may be, for example, from 7 to 10 mm.

In some examples, the pitch w may be, for example, a length from a center-point of the thickness of the first helical-blade portion P1 in the direction of the axis T to a center-point of the thickness of the helical-blade portion P2 in the direction of the axis T.

In examples where the first conveying member 120 includes a single helical blade, such as the first helical blade 122, the first helical blade 122 having the first helical-blade portion P1 as a portion thereof and the first helical blade 122 having the helical-blade portion P2 as a portion thereof refer to the same first helical blade 122. Namely, the first helical-blade portion P1 and the helical-blade portion P2 are parts of the same first helical blade 122. In other examples, where the first conveying member 120 has the plurality of the first helical blades 122, the first helical blade 122 having the first helical-blade portion P1 as a portion thereof may differ from another first helical blade 122' having the helical-blade portion P2 as a portion thereof. For example, a first helical blade 122 may include the first helical-blade portion P1 and another first helical blade 122' may include the second helical-blade portion P2 that is adjacent the first helical-blade portion P1.

The first helical blade 122 may have a thickness t in the direction of the axis T of less than or equal to 2 mm, for example. Accordingly, the thickness t of the helical-blade portion in the direction of the axis T which is a portion of the first helical blade 122 may be, for example, less than or equal to 2 mm. In some example, the thickness of a tip end portion of the first helical blade 122 in a rising direction may be thinner than the thickness of a base end portion of the first helical blade 122 in the rising direction. In this case, the thickness t of the first helical blade 122 in the direction of the axis T may be, for example, taken at a thickest part (a length of the thickest portion) of the first helical blade 122.

The protrusion 125 is provided, for example, on the outer circumferential surface of the first support shaft 121 between the first helical blades 122 adjacent to each other in the direction of the axis T. In some examples, the protrusion 125 may be located between helical-blade portions that are adjacent to each other in the direction of the axis T.

A plurality of the protrusions 125 may be provided on the outer circumferential surface of the first support shaft 121 along the direction of the axis T. The plurality of protrusions 125 may be provided on the outer circumferential surface of the first support shaft 121 in a rotation direction of the first support shaft 121.

Each protrusion 125 has an upper surface 125*a* opposite to a surface of the protrusion 125, which is in contact with the outer circumferential surface of the first support shaft 121. The protrusion 125 may include, for example, a block-shaped body provided on the outer circumferential surface of the first support shaft 121. The protrusion 125 may include, for example, a block-shaped body having a triangular shape when viewed in a direction perpendicular to the axis T. Namely, in this case, the shape of the upper surface 125*a* may be triangle-shaped. The shape of the protrusion 125 and the shape of the upper surface 125*a* are not limited to the shape illustrated in FIG. 5, and the like, and various shapes may be adopted.

The protrusion 125 may be, for example, in contact with the first helical blade 122. The protrusion 125 may be, for example, in contact with the back surface (or rear surface) 122*b* of the first helical blade 122.

Figure 6:
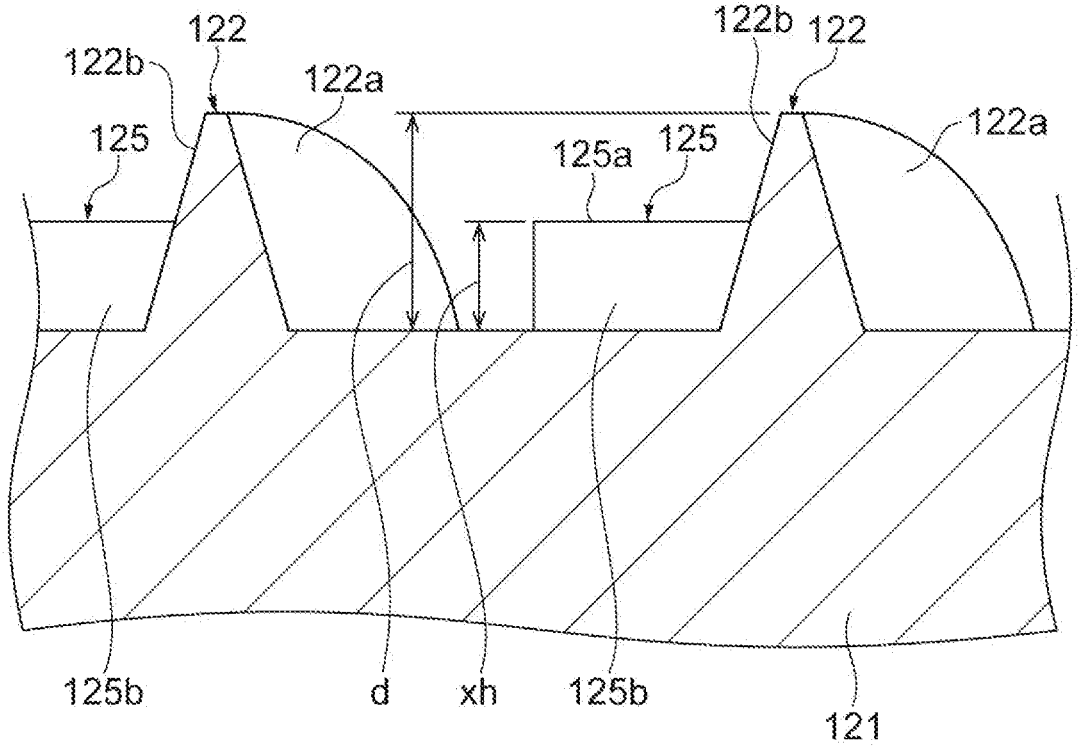
FIG. 6 is a partial cross-sectional view of the conveying member illustrated in FIG. 5, taken along line VI-VI.

With reference to FIG. 6, the protrusion 125 may have a rise height xh from the outer circumferential surface of the first support shaft 121, which is less than or equal to half a rise height d of the first helical blade 122 from the outer circumferential surface of the first support shaft 121. For example, the height xh may satisfy the expression xh≤d/2.

Figure 5:
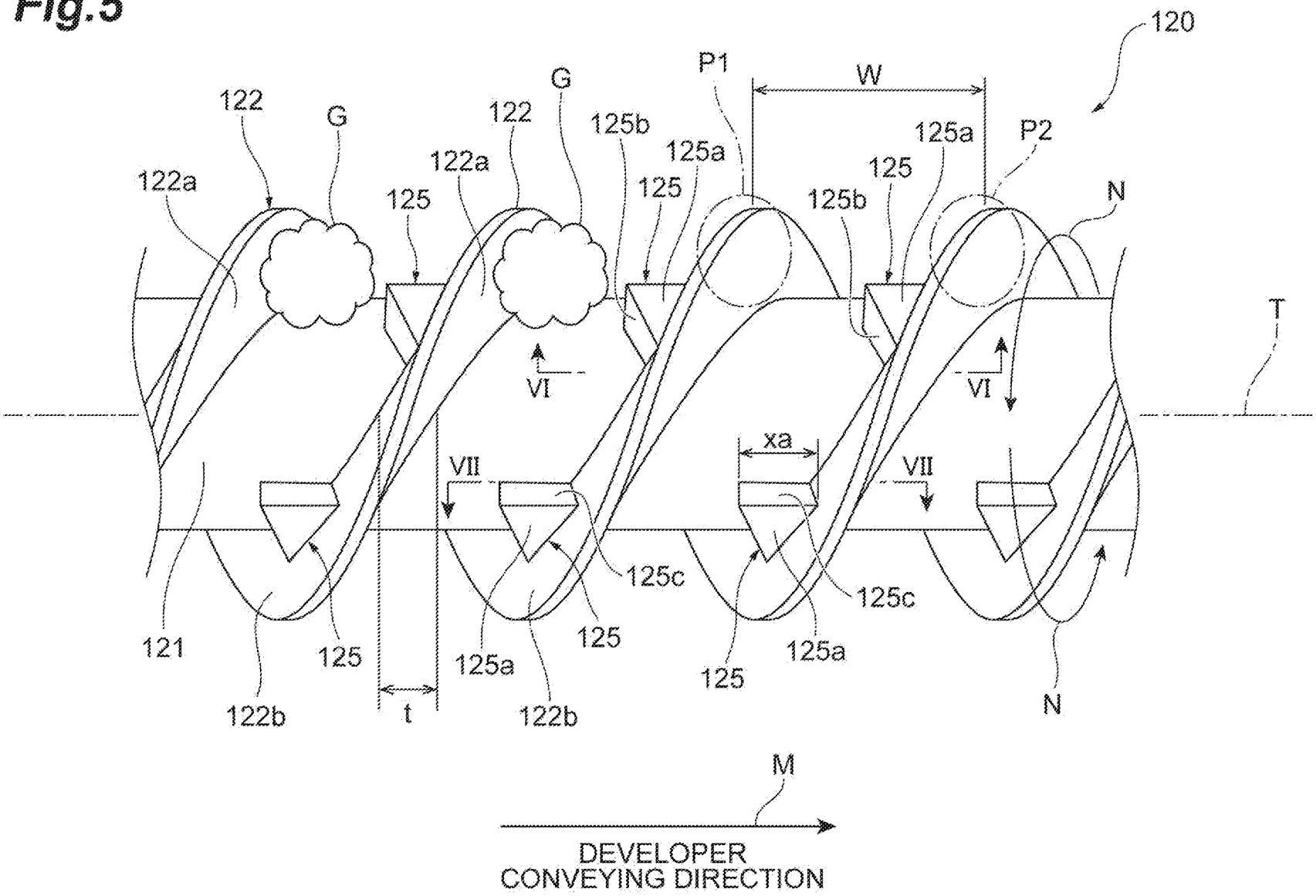
FIG. 5 is a schematic view illustrating an example conveying member.
Figure 7:
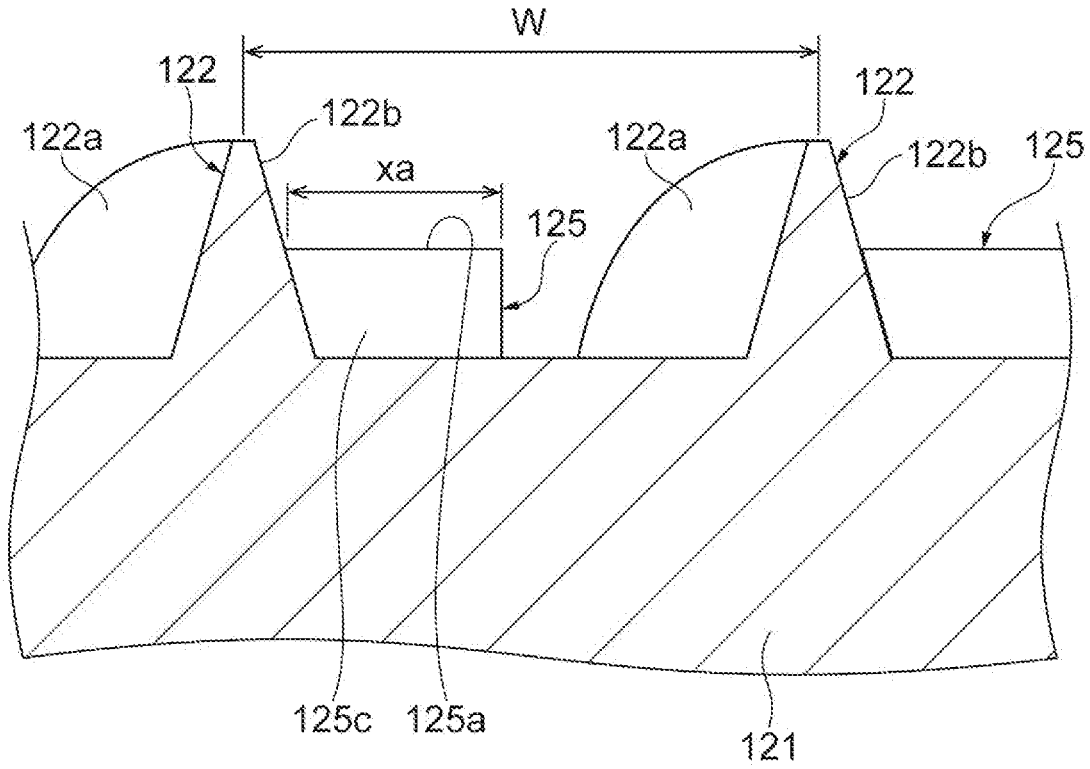
FIG. 7 is a partial cross-sectional view of the conveying member illustrated in FIG. 5, taken along line VII-VII.

With reference to FIGS. 5 and 7, the protrusion 125 may have a width xa in the direction of the axis T that is less than or equal to half the pitch w between the helical-blade portions. For example, the width xa of the protrusion 125 may satisfy the expression xa≤w/2. In some examples, the width xa of the protrusion 125 may be taken at a portion of the protrusion 125 having the greatest width in the direction of the axis T (e.g., a width of a portion of the protrusion 125, which has the longest length in the direction of the axis T). In some examples, the width xa may be a width of an upstream surface 125*c* of the protrusion 125.

With reference to FIG. 5, the protrusion 125 may have, for example, a leading surface 125*b* facing the rotation direction of the first support shaft 121. For example, the leading surface 125*b* faces downstream (e.g., the leading surface 125*b* is oriented substantially toward a downstream side) in the rotation direction of the first support shaft 121.

Figure 8:
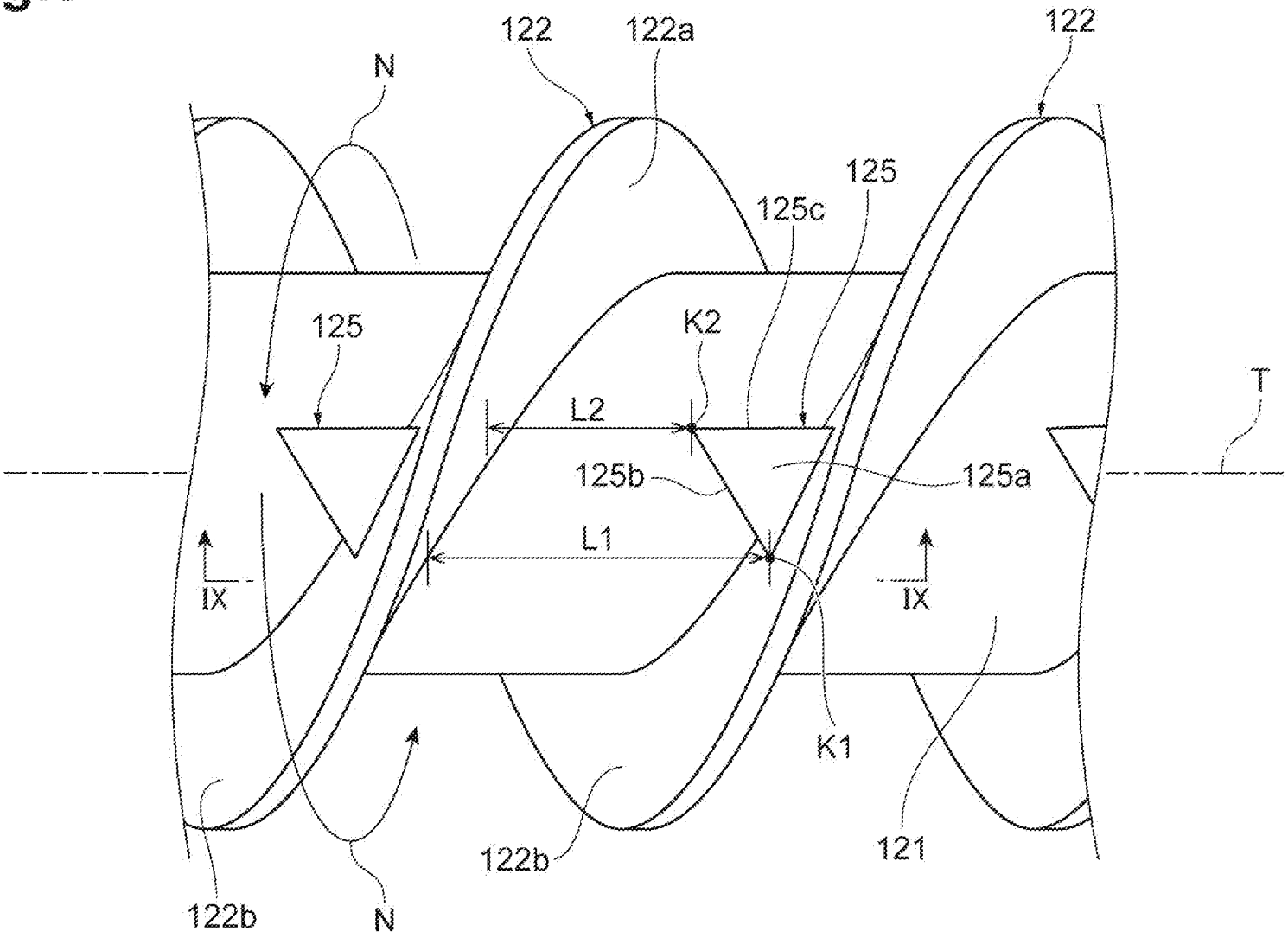
FIG. 8 is a schematic enlarged view of the example conveying member.
Figure 9:
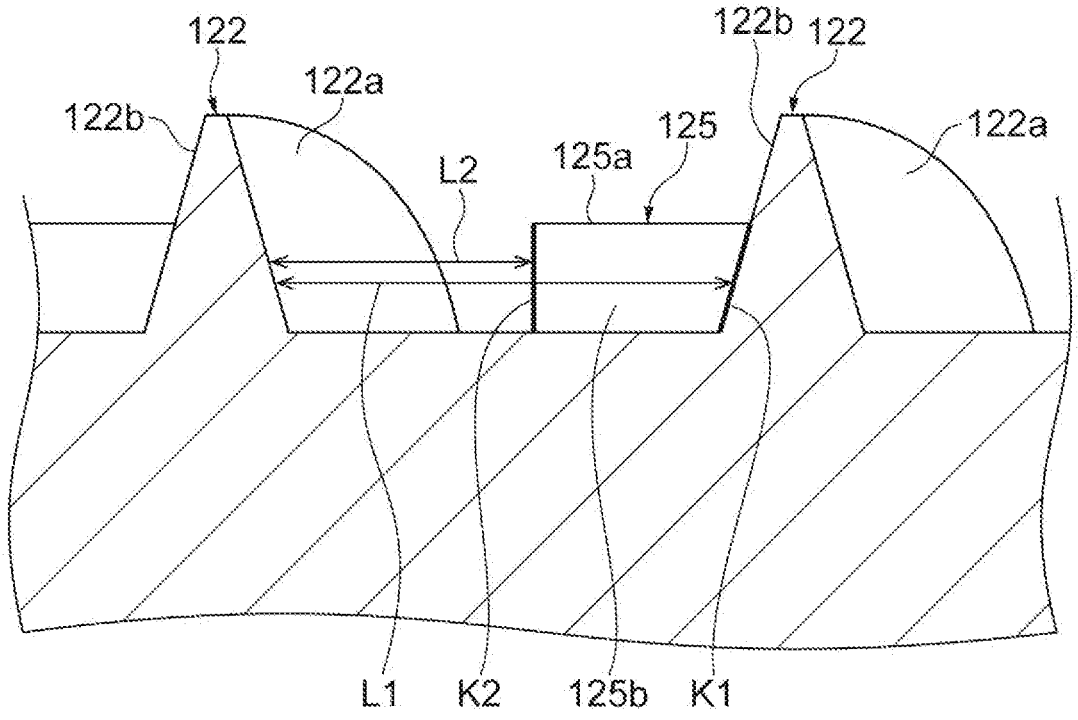
FIG. 9 is a cross-sectional view of the conveying member illustrated in FIG. 8, taken along line IX-IX.

For example, with reference to FIGS. 8 and 9, the leading surface 125*b* may extend from a contact end K1 in contact with the back surface 122*b* of the first helical blade 122 to a protrusion end K2 located between the back surface 122*b* and the conveying surface 122*a*. In some examples, the contact end K1 may be located downstream of the protrusion end K2 in the rotation direction of the first support shaft 121. The protrusion end K2 may not be an end portion of the protrusion 125, which is closest to the conveying surface 122*a*. The protrusion 125 may have a portion that is closer to the conveying surface 122*a* than the protrusion end K2.

In addition, a length L1 (e.g., a first distance) from the conveying surface 122*a* of the first helical blade 122 to the contact end K1 in the direction of the axis T may be longer than a length L2 (e.g., a second distance) from the conveying surface 122*a* to the protrusion end K2 in the direction of the axis T.

Accordingly, in some examples, the leading surface 125*b* may extend from the protrusion end (upstream end) K2 located upstream in the rotation direction of the first support shaft 121 to the contact end (downstream end) K1 located downstream in the rotation direction of the first support shaft 121. In this case, in regard to the length between the conveying surface 122*a* of the first helical blade 122 and the leading surface 125*b* of the protrusion 125 in the direction of the axis T the length L2 from the conveying surface 122*a* to the protrusion end (upstream end) K2 of the leading surface 125*b* may be longer than the length L1 from the conveying surface 122*a* to the contact end (downstream end) K1 of the leading surface 125*b*.

As described above, the contact end K1 may be, for example, a side of the leading surface 125*b*, which is in contact with the back surface 122*b* of the first helical blade 122. In addition, the protrusion end K2 is, for example, a side of the protrusion 125, which is adjacent to the conveying surface 122*a*.

In some examples, the upstream surface 125*c* of the protrusion 125 may face upstream in the rotation direction of the first support shaft 121. In some examples, the upstream surface 125*c* may be provided such that a line perpendicular to the upstream surface 125*c* is parallel to the rotation direction of the first support shaft 121 when viewed along the direction perpendicular to the axis T (cf. FIG. 8). The upstream surface 125*c* may rise from the outer circumferential surface of the first support shaft 121 along a direction normal to the outer circumferential surface of the first support shaft 121 (e.g. a radial direction relative to the shaft 121). If the upstream surface 125*c* is provided, when viewed along the direction perpendicular to the axis T, the protrusion 125 may have a shape delimited by the leading surface 125*b*, the upstream surface 125*c*, and the surface of the protrusion 125, which is in contact with the back surface 122*b*.

Figure 4:
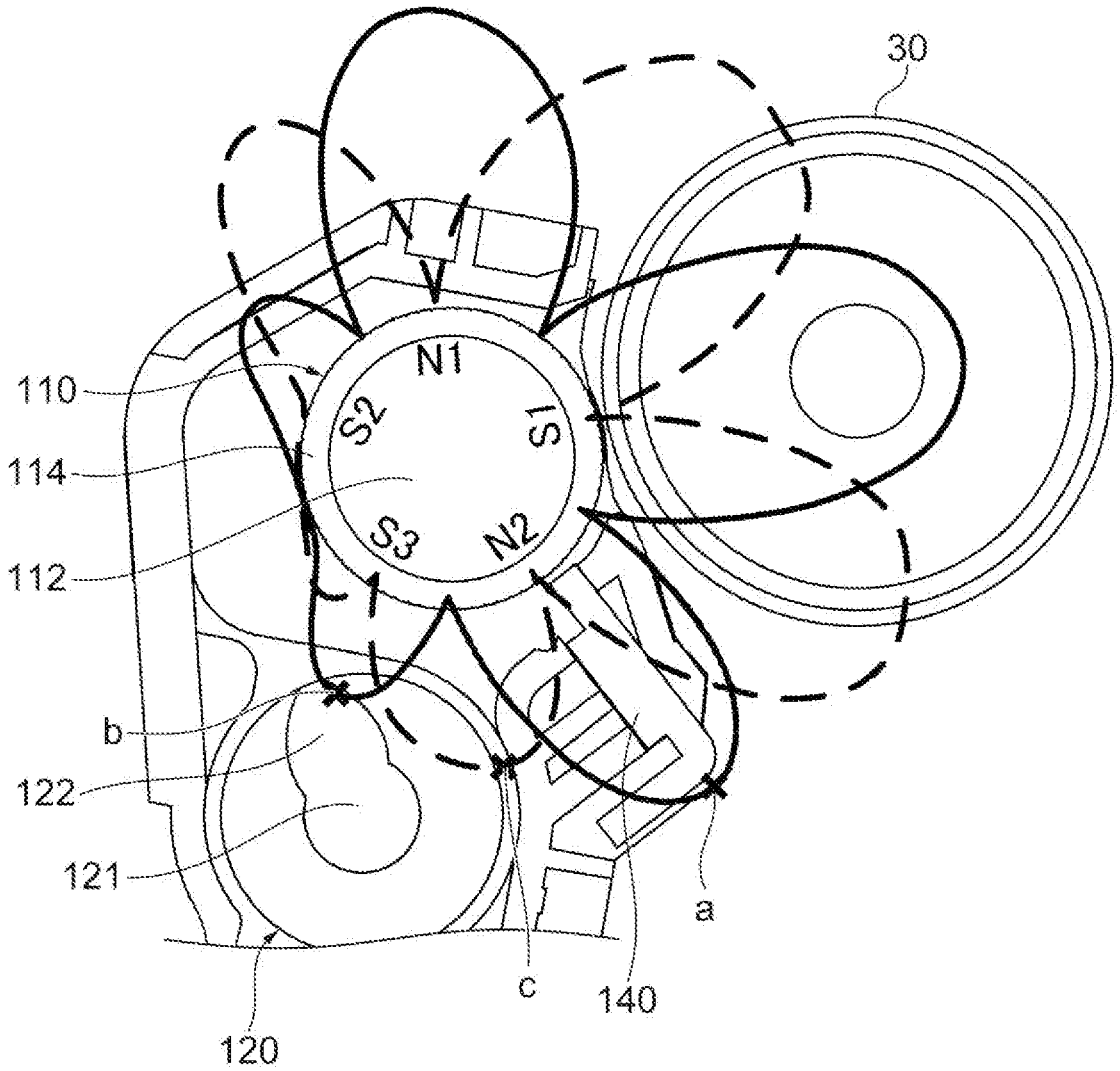
FIG. 4 is a schematic diagram illustrating magnetic forces around a developing roller in an example developing device.

In the example developing device 100, with reference to FIG. 4, when the peak pulling magnetic force b in the direction normal to the pulling pole S3 of the developing roller 110 is decreased, friction between the developer and the developing sleeve 114 is reduced. In addition, if the amount of the developer regulated by the layer regulating member 140 is reduced, friction between the developer and the layer regulating member 140 is reduced. The reduction in friction prevents or inhibits heat generation in the developing device 100.

According to examples of the developing device 100, if the peak layer regulating magnetic force a in the direction normal to the layer regulating pole N2 is decreased, an irregularity in the density of an image formed on the paper P tends to become large. In addition, in the developing device 100, for example, if the peak pulling magnetic force b in the direction normal to the pulling pole S3 is increased, a large amount of heat is generated by friction between the developer and the developing sleeve 114. For this reason, in order to both prevent or inhibit temperature from increasing and to prevent or inhibit the irregularity in density from increasing, the peak layer regulating magnetic force a in the direction normal to the magnetic field formed by the layer regulating pole N2 may be set greater than the peak pulling magnetic force b in the direction normal to the magnetic field formed by the pulling pole S3.

In this case, the total magnetic force of the peak layer regulating magnetic force a in the direction normal to the magnetic field formed by the layer regulating pole N2 and the peak pulling magnetic force b in the direction normal to the magnetic field formed by the pulling pole S3 may be less than or equal to 85 mT, in order to more better prevent or inhibit the temperature from increasing.

The peak layer regulating magnetic force a in the direction normal to the layer regulating pole N2 may be, for example, less than or equal to 50 mT, to better prevent or inhibit friction between the layer regulating member 140 and the developer from causing heat generation. The peak pulling magnetic force b in the direction normal to the pulling pole S3 may be, for example, less than or equal to 35 mT, to better reduce the amount of the developer held by the developing roller 110, by virtue of the magnetic force of the pulling pole S3, and prevent or inhibit heat from being generated by reducing the friction between the developer and the developing sleeve 114. The peak magnetic force c formed in the tangential direction between the layer regulating pole N2 (peak layer regulating magnetic force a) and the pulling pole S3 (peak pulling magnetic force b) may be, for example, less than or equal to 40 mT, in order to better reduce the amount of the developer held by the developing roller 110, and prevent heat from being generated by reducing the friction between the developer and the developing sleeve 114.

In some examples, the first conveying member 120 of the developing device 100 may have, for example, the plurality of rows of the first helical blades 122, in order to supply lesser amounts of the developer to the developing roller 110 at low frequencies. Accordingly, the developer on the outer circumferential surface of the developing roller 110 can be prevented or inhibited from increasing in density.

The thickness t of the first helical blade 122 may be, for example, less than or equal to 2 mm, in order to increase the volume of the developer that can be conveyed by the first helical blade 122, and to increase the absolute (or total) amount of the developer that can be conveyed by the first helical blade 122. In addition, the pitch w between adjacent helical-blade portions in the direction of the axis T may be, for example, from 7 to 10 mm, in order to form a better quality layer of developer, since a lower density amount of the developer is supplied from the first conveying member 120 to the developing roller 110 at lower frequencies, and to reduce or inhibit irregularities in the density of the image. In addition, the thickness t of the first helical blade 122 may be set less than or equal to 2 mm, and the pitch w between the helical-blade portions may be set from 7 to 10 mm, in order to form the image in a more stable manner, even though the amount of the developer inside the developing device 100 has been changed or the state of the developer has been changed due to the environment or aging over time, by virtue of a synergy effect between the thickness of the first helical blade 122 and the pitch between the helical-blade portions.

In some examples, the first conveying member 120 may include the protrusion 125, in order for the first conveying member 120 to more easily or effectively push (or convey) the developer out to the developing roller 110 when the first support shaft 121 rotates. Therefore, the first conveying member 120 may better supply the developer to the developing roller 110. As a result, even though the amount of the developer inside the developing device 100 has been changed, the irregularities in the density of the image formed may be prevented or inhibited from increasing.

In addition, the protrusion 125 may have, for example, the leading surface 125*b* described above. Accordingly, when the first support shaft 121 rotates, the first conveying member 120 may more readily release the developer from between the leading surface 125*b* and the back surface 122*b* of the first helical blade 122 while preventing the developer from staying too long in front of the leading surface 125*b*.

The protrusion 125 may be, for example, in contact with the back surface 122*b* of the first helical blade 122. When the first helical blade 122 supplies the developer to the developing roller 110 while conveying the developer, in a region between the conveying surface 122*a* and the other conveying surface 122*a* facing the conveying surface 122*a*, the density of the developer in a region immediately in front of the conveying surface 122*a* is high, and the density of the developer in a region immediately in front of the back surface 122*b* is low. The protrusion 125 is in contact with the back surface 122*b*, therefore the protrusion 125 is located in the region where the density of the developer is low. Accordingly, the developing device 100 may better supply the developer also in a region, in which the density of the developer is low, to the developing roller 110 by virtue of the protrusion 125.

In addition, if the size of the protrusion 125 is increased, the effect of the irregularity in the density of the formed image tends to increase, and developer conveying performance tends to deteriorate. For this reason, the width xa of the protrusion 125 in the direction of the axis T may be, for example, less than or equal to half the pitch w between the helical-blade portions. In addition, the rise height xh of the protrusion 125 may be, for example, less than or equal to half the rise height d of the first helical blade 122. Accordingly, the irregularity in the density of the formed image is improved while preventing the developer conveying performance from deteriorating.

In addition, the protrusion 125 may have, for example, the upstream surface 125*c* facing upstream in the rotation direction of the first support shaft 121. For example, the upstream surface 125*c* may be provided such that the line perpendicular to the upstream surface 125*c* is parallel to the rotation direction of the first support shaft 121 when viewed along the direction perpendicular to the axis T (condition illustrated in FIG. 8). In this case, when the first support shaft 121 rotates, the protrusion 125 is capable of more quickly moving or conveying the developer to a rearward (upstream in the rotation direction of the first support shaft 121) region in a movement direction of the protrusion 125. Therefore, the density of the developer in the rearward region in the movement direction of the protrusion 125 can be prevented from diminishing by the first conveying member 120.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A developing device comprising:

a developer carrier to carry a developer; and a developer conveyor to supply the developer to the developer carrier, wherein the developer conveyor includes a shaft extending in an axial direction to rotate in a rotational direction, a helical blade having a conveying surface to convey the developer around the shaft along the axial direction, a pitch in the axial direction between adjacent helical-blade portions of the helical blade being approximately 7 to 10 mm, and a protrusion attached to a rear surface of the helical blade, which faces the conveying surface, and having a leading surface extending from an upstream end to a downstream end in the rotational direction of the shaft.

2. The developing device according to claim 1, wherein a first distance taken between the conveying surface and the upstream end of the leading surface of the protrusion is shorter than a second distance taken between the conveying surface and the downstream end of the leading surface of the protrusion.

3. The developing device according to claim 1, wherein the helical blade includes a plurality of the helical-blade portions spaced apart from each other along the axial direction, and wherein a width of the protrusion in the axial direction is equal to or less than approximately half a pitch between adjacent ones of the helical-blade portions that are adjacent to each other in the axial direction.

4. The developing device according to claim 1, wherein a height of the protrusion taken from the shaft is equal to or less than approximately half a height of the helical blade taken from the shaft.

5. The developing device according to claim 1, wherein the developer conveyor includes a plurality of helical blades provided on the shaft.

6. An image forming system comprising:

a developer conveyor to supply a developer, wherein the developer conveyor includes:

a shaft extending in an axial direction, a plurality of helical-blade portions spaced apart along the axial direction of the shaft, a pitch in the axial direction between adjacent helical-blade portions being approximately 7 to 10 mm, and a protrusion located between adjacent helical-blade portions;

a developer carrier to carry the developer, wherein the developer carrier includes:

a first magnetic pole forming a first magnetic field to transfer the developer from the developer conveyor to the developer carrier, wherein the first magnetic pole is associated with a first peak magnetic force in a direction normal to the first magnetic field, and a second magnetic pole forming a second magnetic field, wherein a second peak magnetic force in a direction normal to the second magnetic field is greater than the first peak magnetic force; and a layer regulating member facing the second magnetic pole of the developer carrier, to control a thickness of a layer of the developer on the developer carrier.

7. The image forming system according to claim 6, wherein the protrusion is in contact with one of the helical-blade portions.

8. The image forming system according to claim 6, wherein each of the helical-blade portions has a conveying surface to convey the developer in the axial direction, and a rear surface opposite the conveying surface, and wherein the protrusion is in contact with the rear surface of one of the adjacent helical-blade portions.

9. The image forming system according to claim 6, wherein a width of the protrusion taken in the axial direction is equal to or less than approximately half the pitch between the adjacent helical-blade portions in the axial direction.

10. The image forming system according to claim 6, wherein a height of the protrusion from the shaft is equal to or less than approximately half a height of the helical blade from the shaft.

11. The image forming system according to claim 6, wherein a total magnetic force of the first peak magnetic force and the second peak magnetic force is equal to or less than approximately 85 mT.

12. The image forming system according to claim 11, wherein the second peak magnetic force is equal to or less than approximately 50 mT.

13. The image forming system according to claim 11, wherein the first peak magnetic force is equal to or less than approximately 35 mT.

14. The image forming system according to claim 6, wherein a thickness of the helical-blade portion in the axial direction is equal to or less than approximately 2 mm.

15. The image forming system according to claim 6, wherein a third peak magnetic force formed in a tangential direction between the first magnetic pole and the second magnetic pole is equal to or less than approximately 40 mT.

16. An apparatus comprising:

a developer conveyor to supply developer to a developer carrier, wherein the developer conveyor includes a shaft extending in an axial direction to rotate in a rotational direction, a helical blade having a conveying surface to convey the developer around the shaft along the axial direction, a pitch in the axial direction between adjacent helical-blade portions being approximately 7 to 10 mm, and a protrusion attached to a rear surface of the helical blade, which faces the conveying surface, and having a leading surface extending from an upstream end to a downstream end in the rotational direction of the shaft.

17. The developing device according to claim 16, wherein a first distance taken between the conveying surface and the upstream end of the leading surface of the protrusion is shorter than a second distance taken between the conveying surface and the downstream end of the leading surface of the protrusion.

18. The developing device according to claim 16, wherein the helical blade includes a plurality of the helical-blade portions spaced apart from each other along the axial direction, and wherein a width of the protrusion in the axial direction is equal to or less than approximately half a pitch between adjacent ones of the helical-blade portions that are adjacent to each other in the axial direction.

19. The developing device according to claim 16, wherein a height of the protrusion taken from the shaft is equal to or less than approximately half a height of the helical blade taken from the shaft.

20. The developing device according to claim 16, wherein the developer conveyor includes a plurality of helical blades provided on the shaft.

* * * * *